US006273329B1

(12) United States Patent
Zavatone

(10) Patent No.: US 6,273,329 B1
(45) Date of Patent: Aug. 14, 2001

(54) CLOSURE FOR HAND FILLED BAKERY PACKAGES UTILIZING COHESIVE MATERIAL

(75) Inventor: James F. Zavatone, Loveland, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/372,918

(22) Filed: Aug. 12, 1999

(51) Int. Cl.[7] ..... B65D 5/00

(52) U.S. Cl. ..... 229/102; 229/224; 229/241; 229/210

(58) Field of Search ..... 229/228, 223, 229/102, 224, 132, 221, 240, 241, 247, 216, 222; 206/815

(56) References Cited

U.S. PATENT DOCUMENTS

| | | | | |
|---|---|---|---|---|
| Re. 26,471 | * | 10/1968 | Meyers | 229/132 X |
| 2,052,977 | | 9/1936 | Hofmann . | |
| 2,162,556 | | 6/1939 | Lagaard . | |
| 2,336,706 | | 12/1943 | Sunderhauf . | |
| 2,868,432 | * | 1/1959 | Guyer | 229/241 |
| 2,928,582 | | 3/1960 | Klein . | |
| 3,088,624 | | 5/1963 | Kinghorn . | |
| 3,108,735 | * | 10/1963 | Meyers et al. | 229/241 |
| 3,191,847 | | 6/1965 | Moore . | |
| 3,368,737 | * | 2/1968 | Ingle | 229/241 |
| 3,507,442 | * | 4/1970 | Van Dam et al. | 229/240 |
| 3,638,853 | * | 2/1972 | Perry | 229/132 X |
| 3,827,625 | | 8/1974 | Miller . | |
| 3,835,988 | * | 9/1974 | Buttery | 229/241 |
| 3,958,748 | | 5/1976 | Smith . | |
| 4,195,765 | * | 4/1980 | Roccaforte et al. | 229/132 X |
| 4,327,833 | * | 5/1982 | Kuchenbecker | 229/222 |
| 4,333,569 | | 6/1982 | Hammacher . | |
| 4,441,614 | | 4/1984 | Gulliver . | |
| 4,573,634 | * | 3/1986 | Kohler et al. | 229/102 X |
| 4,989,730 | * | 2/1991 | Lemoine | 206/815 X |
| 5,197,618 | | 3/1993 | Goth . | |
| 5,326,024 | * | 7/1994 | Fogle | 229/214 |
| 5,655,707 | | 8/1997 | Jensen . | |
| 5,735,454 | | 4/1998 | Jensen . | |

* cited by examiner

*Primary Examiner*—Allan N. Shoap
*Assistant Examiner*—Tri M. Mai
(74) *Attorney, Agent, or Firm*—Michael J. Doyle

(57) ABSTRACT

A paperboard container adapted to hold pastries or the like is fashioned from a unitary blank. The blank is provided with a plurality of generally rectangular panels defined by fold lines. The container assumes two forms, with each having a bottom panel with upstanding side walls therefrom to define a bottom tray, a top panel with depending side walls therefrom to define a top tray, and two latching tabs. One latching tab is carried by the front wall of the lower tray, while the other latching tab is carried by the front wall of the upper tray. The two front walls are overlapping and in substantial surface contact with each other. Each latching tab is outwardly bendable from its respective front wall, with each latching tab being coated on at least one surface with a cohesive material. Such a material has the property that it adheres only to other cohesive material coated surfaces. The cohesive material surfaces of the latching tabs are placed in surface to surface contact after bending them outwardly, so that they are adhered together, to thereby hold together the respective front walls. To open the container, the latching tabs are either simultaneously torn off, or manually pulled apart.

5 Claims, 5 Drawing Sheets

CLOSURE FOR HAND FILLED BAKERY PACKAGES UTILIZING COHESIVE MATERIAL

BACKGROUND OF THE INVENTION

This invention relates to hand filled bakery packages fashioned from paperboard. Generally, such packages or containers are not provided with a tamper evident device. In a typical package of this type a single anchor lock is used to secure the package hinge cover to the carton base after filling. Operators filling the packages sometimes encounter difficulty in engaging the lock. Further, opening the package was sometimes difficult for the consumer.

SUMMARY OF THE INVENTION

According to the present invention, a tamper evident bakery package is formed which requires only a single ripping or tearing action to open it, while also providing a tamper evident construction.

The free edges of two opposite and overlapping side wall panels are each provided with a cohesive coated tab. Each tab is bent out about ninety degrees from its side wall panel, with the two cohesive material coated surfaces placed in contact with each other. This precludes opening of the package. In one embodiment of the invention, the base of each tab carries a tear line, to thereby permit the adhered together tabs to be torn off together, so that the package may be opened. In another embodiment, the tabs are manually pulled apart for opening.

DETAILED DESCRIPTION OF THE INVENTION

Figure 1:
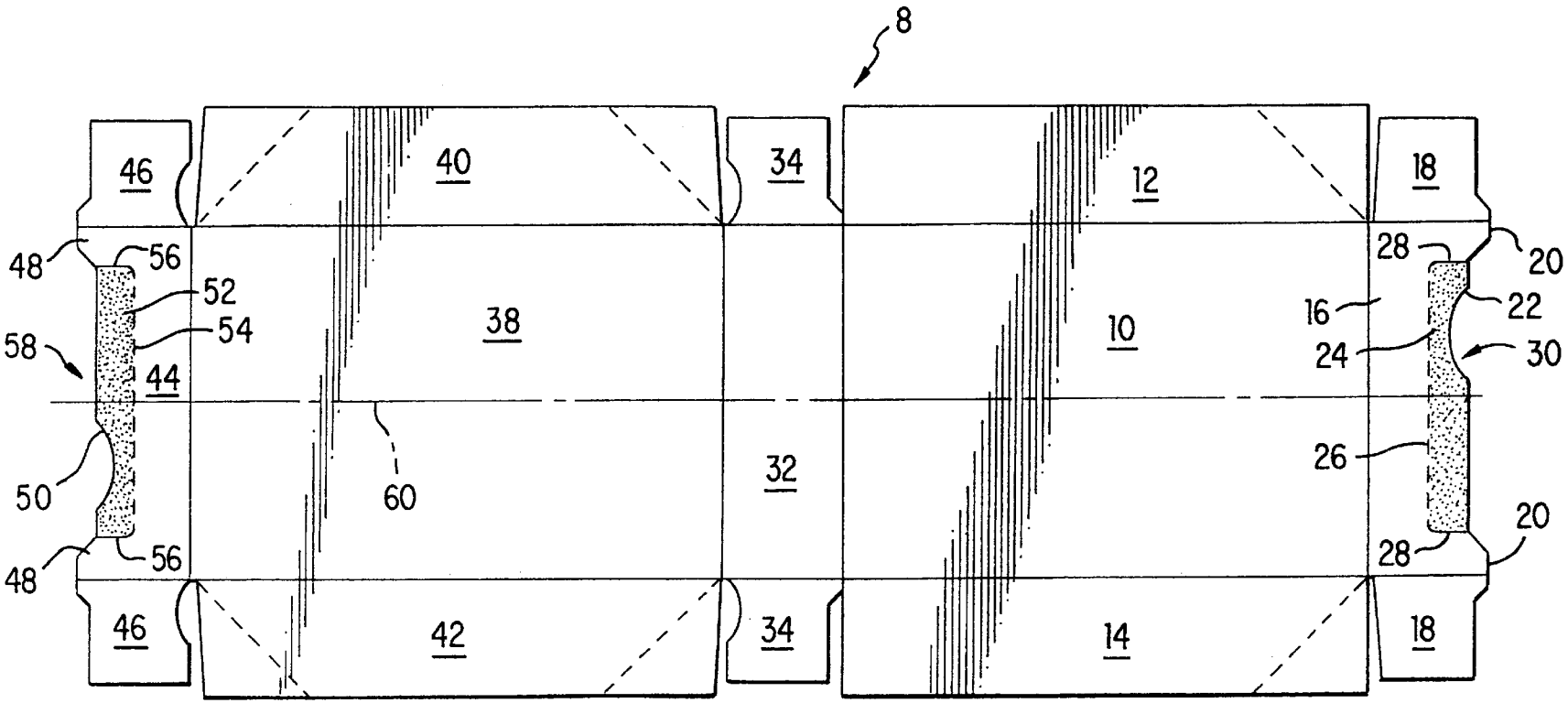
FIG. 1 is a plan view of a unitary paperboard blank for forming a bakery package according to one embodiment.

Referring now to FIG. 1 of the drawings, a unitary paperboard blank for forming one of the embodiments of this invention is designated as 8. The blank has a plurality of straight fold lines separating it into a plurality of generally rectangular panels. Panel 10 is a top forming panel and carries upper and lower side panels 12 and 14, respectively. An upstanding side wall forming panel is designated as 16, the latter having upper and lower tabs 18. It is seen that tabs 18 are secured to panel 16 by respective fold lines. The right edge of blank 10 is termed a free edge in the sense that it is not foldably secured to any other panel, with this free edge including two spaced protuberances 20. Stippled area 24 denotes a covering of cohesive material. A plurality of spaced apart cut lines 26, together with horizontal cut lines 28, defines a tab denoted generally as 30. This tab is coated on one side, such as the side facing the reader, with the cohesive material 24. The free edge of tab 30 is provided with an arcuate depression or recess 22. Cohesive materials are known in this art, as may be seen by reference to U.S. Pat. Nos. 5,655,707 and 5,735,454, both issued to Jensen, hereby incorporated by reference.

The left-hand edge of panel 10 is foldably secured to another upstanding side wall forming panel 32, the latter provided with integral panels or sections 34, secured to side wall 32 by fold lines.

Left panel 38 is a bottom forming panel and is provided with side wall forming portions 40 and 42, respectively, at its upper and lower ends. These side wall portions are also integrally secured to panel 38 by fold lines.

The left portion of panel 38 is connected by the indicated vertical fold line to side wall forming panel 44, with side wall 44 being of a construction similar to that of side wall 16. Side wall 44 has a free edge along its left portion, namely, an edge which is not secured to any other panel or element. Upper and lower reinforcing panels 46 are secured to side wall 44 by fold lines, with the left free edge of the latter having protuberances 48, similar to protuberances 20 on the right of the blank. The left free edge of side wall 44 carries an arcuate depression or recess 50, similar to recess 22 previously described. Stippled region 52 denotes a cohesive covering or layer, while a series of spaced cuts 54 communicates with horizontal cut lines 56 above and below to define closure or sealing tab 58. Tab 58 is similar to tab 30 previously described. The longitudinal mid axis of blank 8 is denoted as 60. In FIG. 1, lines 26 and 54 are about midway of the full width of respective panels 16 and 44. The slanted and dashed fold lines of panels 12, 40, and 42 are conventional.

While panel 10 has been described as a bottom forming panel, it is clear that it could be a top forming panel, merely by inverting the erected package, the latter now described. Similarly, depending on how the blank is folded, the cohesive material may be placed on that side of tabs 30 and 58 away from the reader as well as facing the reader, or even on both tab surfaces.

Figure 2:
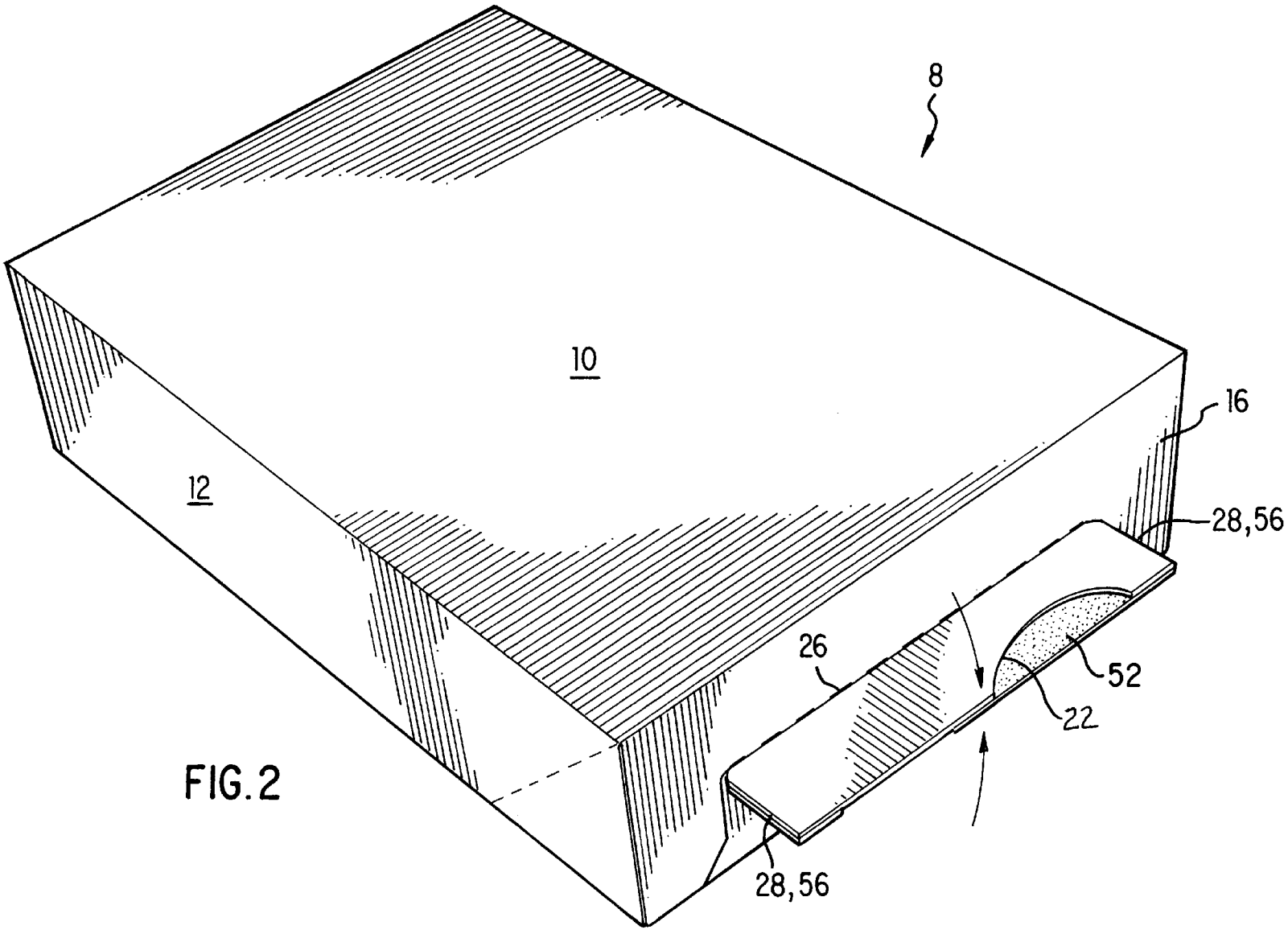
FIG. 2 is a perspective view of a bakery package formed from the blank of FIG. 1, the package shown in its closed and sealed configuration.

FIG. 2 illustrates the blank of FIG. 1 after folding the latter and erecting it. The manner of folding and erecting the package, both manually or by machinery, is known and forms no part of the invention.

Figure 3:
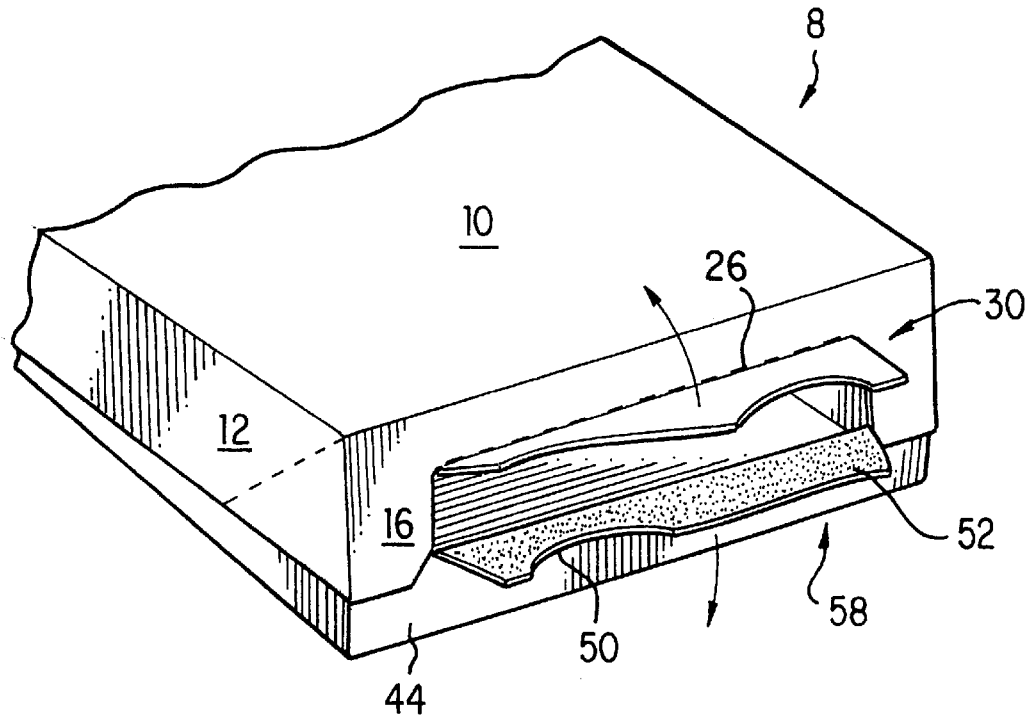
FIG. 3 is a partial perspective view, showing the right portion of FIG. 2 as being opened by pulling apart certain closure or sealing tabs.

Assuming panel 10 to be the top panel of the package, tabs 30 and 58 are bent outwardly, about fold lines 26 and 54, substantially ninety degrees from their respective panels 16 and 44 and pushed together, as indicated by the curved arrows. The package, with bakery products therein, is now closed and sealed by having placed the cohesive coatings or layers in surface to surface contact. Panels 16 and 44 are in at least substantial surface to surface contact, being substantially overlapped. To open the package, as shown at FIG. 3, the consumer pulls tabs 30 and 58 apart, utilizing recesses 22 and 50 if required, thus permitting the top and bottom panels to swing apart and expose the bakery products. The curved arrows show this action. Only by such pulling is the package openable and thus, by the nature of cohesive coatings 24 and 52 and tabs 30 and 58, the package is tamper evident.

Figure 4:
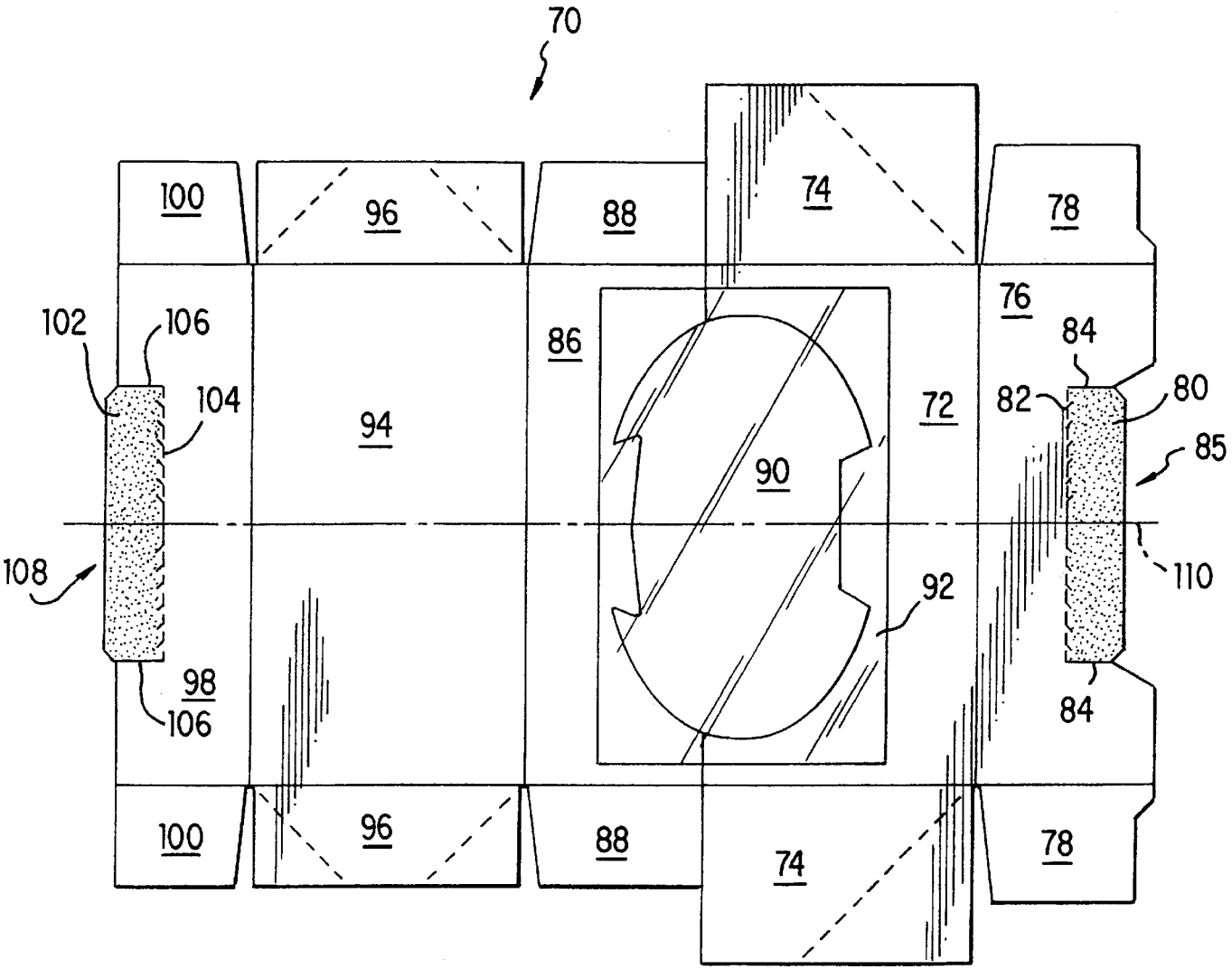
FIG. 4 is a plan view of a unitary paperboard blank for forming a bakery package according to a second embodiment.

Referring now to FIG. 4 of the drawings, another unitary paperboard blank for forming a package of this invention is shown, here designated as 70. The blank includes a plurality of panels separated and defined by straight fold lines. A top forming panel is denoted as 72 and is provided in its upper and lower edges with panels 74. The right portion of the blank is provided with side wall panel 76 having upper and lower panels 78 as indicated. Stippling 80 denotes a cohesive covering, while separated cut lines 82 communicate with cut lines 84 at the top and bottom of line 82, to define a tear off tab 85. It will be seen that tab 85 lies in a plane defined by side wall panel 76, with tab 85 adapted to be bent out of this plane, as will later be described in detail. Side wall forming panel 86 is connected to the left portion of panel 72, with panel 86 foldably secured to upper and lower panels 88. An opening 90 is precut in panels 72 and 86, with opening 90 being covered by a clear plastic sheet 92 secured by a suitable adhesive so as to cover opening 90.

A bottom forming panel 94 is connected to left portion of panel 86, with panel 94 having upper and lower panels 96 as indicated. The slanted and dashed fold lines of panels 74 and 96 are conventional.

The left portion of panel 94 is secured to side wall forming panel 98, the latter having respective upper and lower panels 100 secured to its upper and lower ends. Stippled region 102 denotes a coating or layer of cohesive material, with a plurality of cuts 104 intersecting horizontal cuts 106 which extend completely through panel 98. Lines 104 and 106 define tab 108, tab 108 having a free left edge. Tab 108 is adapted to be bent out of the plane of panel 98, as will later be described. The mid longitudinal axis of blank 70 is denoted as 110.

Figure 5:
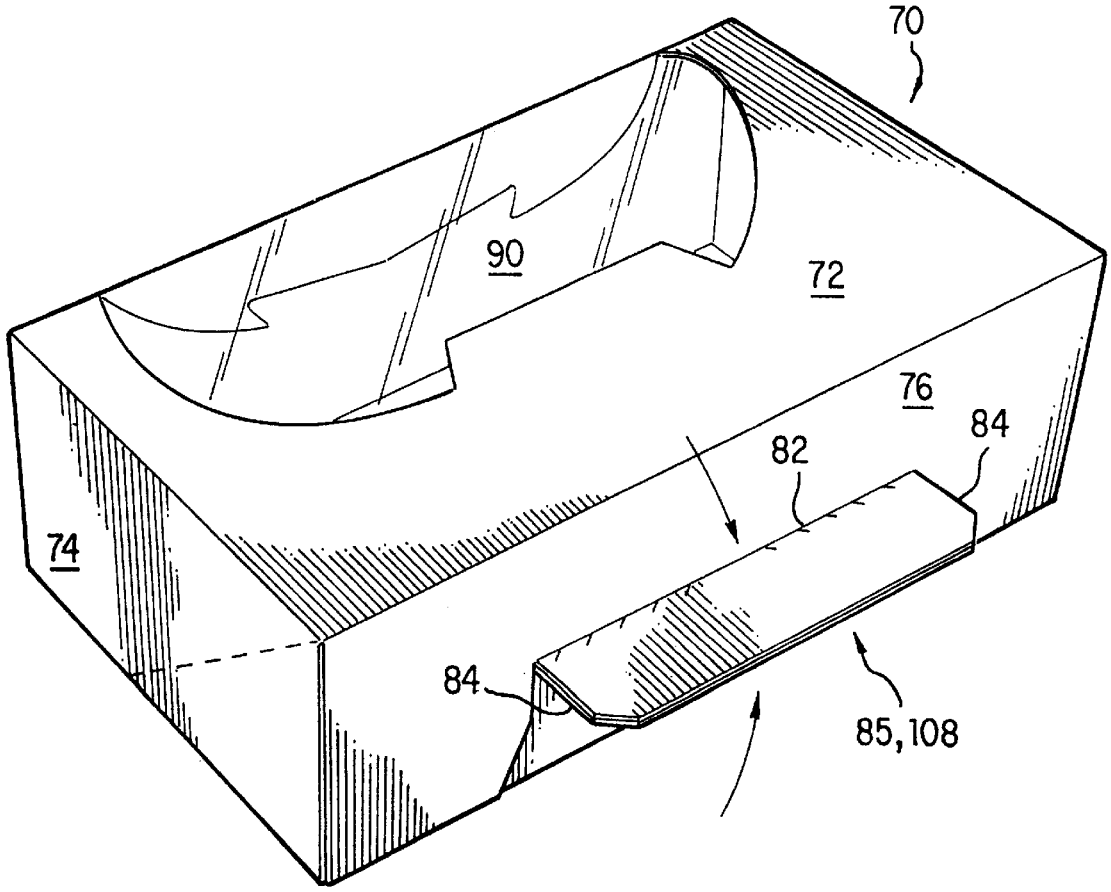
FIG. 5 is a perspective view of a bakery package formed from the blank of FIG. 4, the package shown in its closed and sealed configuration.

As shown in FIG. 5, the blank has been erected, filled with bakery product, and closed or sealed by bending tabs 85 and 108 out of the plane of their respective panels, and pushing their respective cohesive coatings together in at least partial surface to surface contact, as indicated by the curved arrows.

Figure 6:
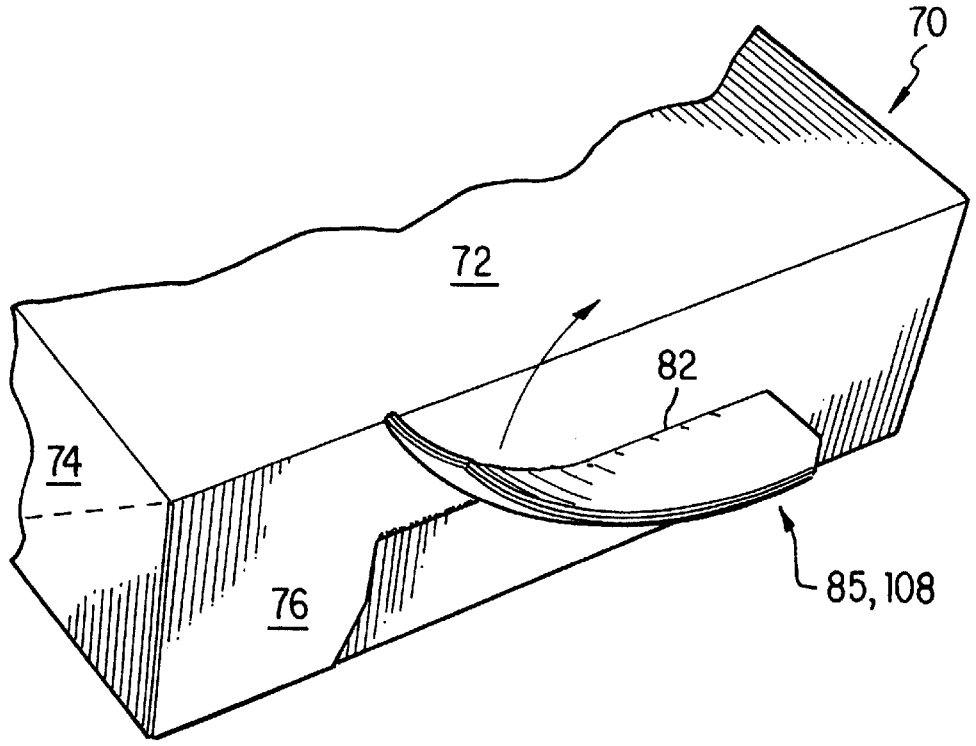
FIG. 6 is partial perspective view of the package of FIG. 5 being opened by ripping off certain closure or sealing tabs.

FIG. 6 shows the package opening action. One end of the two latching or closure tabs 85, 108 are pulled upwardly (or downwardly) so as to rip them simultaneously from the package. The top and bottom of the package may now be swung open to expose the product.

One side wall is defined by panels 16 and 44 of the first embodiment, and by panels 76 and 98 of the second embodiment. Each of these panels carries a latching tab. In the case of a four sided package, as shown, these two sets of panels are often termed front wall panels. In the case of an eight sided package for example, the cohesive latching tabs could be placed at the free edges of any two side walls or side forming panels, including so called front wall panels, in order to obtain a similar tamper evident closure.

What is claimed is:

1. A paperboard container formed from a unitary paperboard blank, said container having a horizontal bottom wall, a horizontal top wall, and vertical side walls to thereby define a closed container, at least one of said side walls including two parallel panels in at least partial surface to surface contact with each other, each of said two parallel panels having a latching tab, each said latching tab having a base securing it to its respective panel, each said latching tab base having a tear line, each said latching tab being bent along its respective said tear line out of a plane defined by its respective panel, said latching tabs being in at least partial surface to surface contact, those surfaces of said latching tabs which are in at least partial surface to surface contact each being coated with a cohesive material, said two latching tabs maintaining said container closed, said container being opened by simultaneously tearing off said latching tabs along their respective said tear lines to permit said top and bottom walls of said container to swing apart.

2. The paperboard container of claim 1 wherein said container is formed from a unitary blank.

3. The container of claim 1 wherein each said latching tab base tear line has a length, said tear line length being less than that of its respective panel.

4. A unitary paperboard blank for forming a container, said blank having opposite longitudinal portions, said blank including a plurality of generally rectangular panels separated by fold lines, said panels including a bottom forming panel having a side panel foldably attached thereto, a top forming panel having a side panel foldably attached thereto, each of said side panels having a free edge, said two free edges each located at respective said opposite portions of said blank, said two opposite free edges each provided with a latching tab, each said latching tab having a base, each said latching tab being bendable along its respective said base out of a plane defined by its respective said side panel, each said latching tab being coated with a cohesive material on at least one surface thereof, each said latching tab base having a tear line to enable said latching tab to be bent and later to be torn off from its respective said side panel, to thereby open the container.

5. The blank of claim 4 wherein each said latching tab base tear line has a length, said tear line length being less than that of its respective panel.

* * * * *

UNITED STATES PATENT AND TRADEMARK OFFICE

CERTIFICATE OF CORRECTION

PATENT NO. : 6,273,329 B1
DATED : August 14, 2001
INVENTOR(S) : James F. Zavatone and Paul D. Richardson It is certified that error appears in the above-identified patent and that said Letters Patent is hereby corrected as shown below:

Title page,
Item [75], should read as follows:
[75] Inventors: James F. Zavatone
Paul D. Richardson Signed and Sealed this Eleventh Day of December, 2001

*Attest:*

Nicholas P. Godici

*Attesting Officer*

NICHOLAS P. GODICI
*Acting Director of the United States Patent and Trademark Office*